United States Patent [19]

Barker

[11] 4,325,208

[45] Apr. 20, 1982

[54] METHOD OF AND APPARATUS FOR UTILIZING AUXILIARY GRID IN CASE PACKER MACHINE

[75] Inventor: Theodore L. Barker, Hudson, Ohio

[73] Assignee: Figgie International Inc., Willoughby, Ohio

[21] Appl. No.: 113,692

[22] Filed: Jan. 21, 1980

[51] Int. Cl.[3] ..... B65B 21/06; B65B 57/04

[52] U.S. Cl. ..... 53/448; 53/69; 53/248; 53/497; 198/491

[58] Field of Search ..... 53/248, 497, 67, 69, 53/498, 499, 443, 448, 495; 193/32, 35 A; 198/491, 492

[56] References Cited

U.S. PATENT DOCUMENTS

| | | | |
|---|---|---|---|
| 2,686,623 | 8/1954 | Wimmer et al. | 53/248 X |
| 2,735,599 | 2/1956 | Thurman | 53/248 X |
| 2,763,236 | 9/1956 | Cummings | 198/491 X |
| 3,052,071 | 9/1962 | Copping | 53/497 |
| 3,116,579 | 1/1964 | Carter | 53/248 X |
| 3,160,259 | 12/1964 | Dalton | 53/497 X |
| 3,385,027 | 5/1968 | Copping et al. | 53/248 |
| 3,421,285 | 1/1969 | Barker | 53/497 |
| 3,473,289 | 10/1969 | Vadas | 53/497 |
| 4,160,354 | 7/1979 | Asper | 53/497 |

*Primary Examiner*—James F. Coan

*Attorney, Agent, or Firm*—Oldham, Oldham, Hudak & Weber Co.

[57] ABSTRACT

Case packer apparatus having an upper grid supplied with streams of rows of abutted articles for receipt for case packing action, a lower grid of corresponding size and article grouping as the upper grid is positioned directly thereunder and is operatively connected thereto by position control means, such control means secure the lower grid to the upper grid for vertical movement to and away from a position adjacent the upper grid, drop fingers depend from the lower grid and are engageable with a case on a case supply conveyor having a horizontal operative course positioned directly below the vertically aligned grids.

5 Claims, 8 Drawing Figures

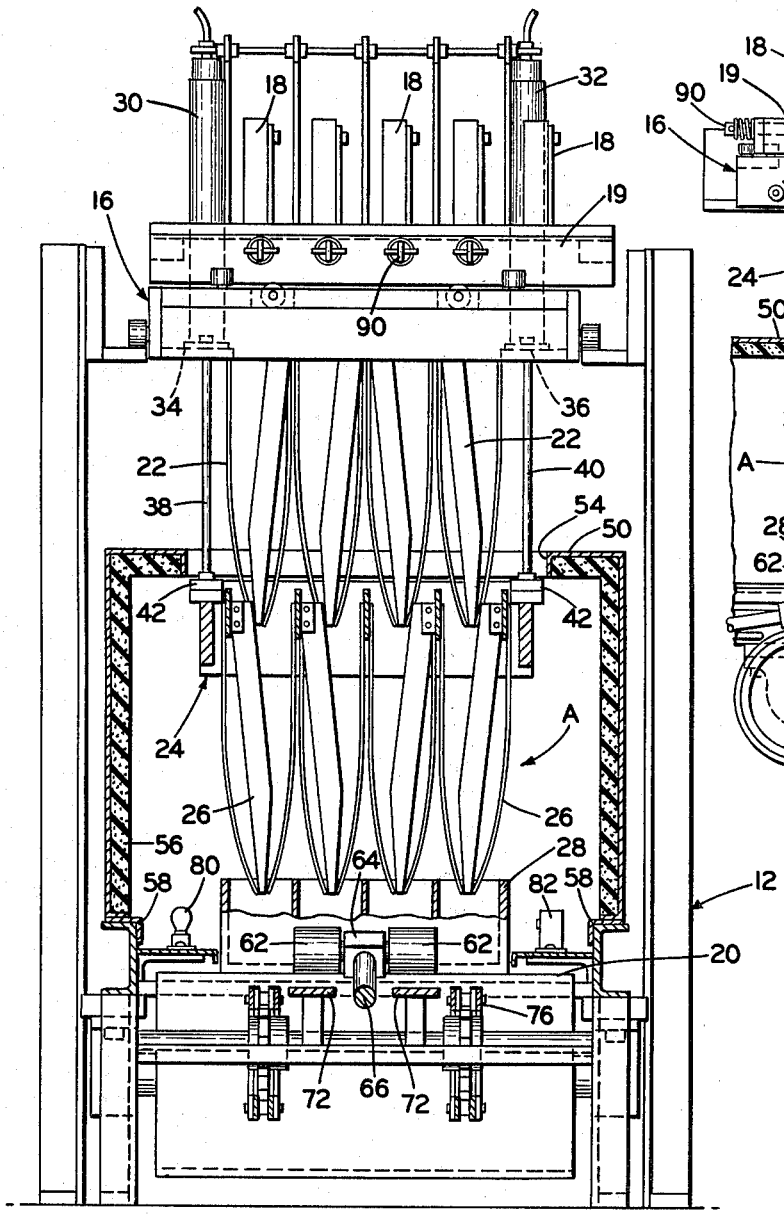
FIG. 2
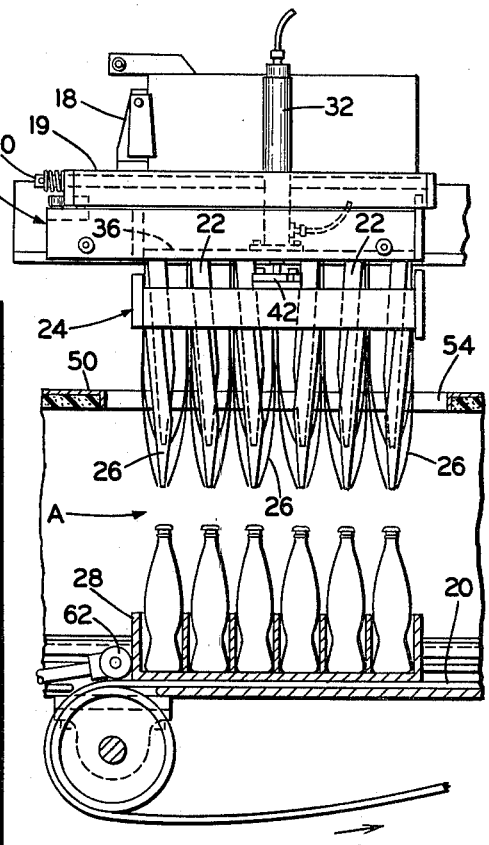
FIG. 4
FIG. 5
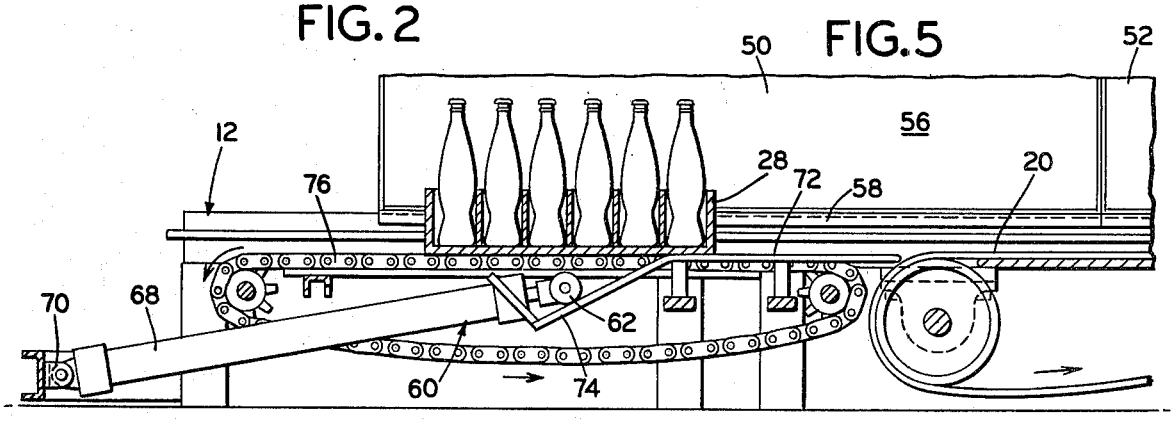

METHOD OF AND APPARATUS FOR UTILIZING AUXILIARY GRID IN CASE PACKER MACHINE

BACKGROUND OF THE INVENTION AND PRIOR ART

Heretofore there have been many different types of case packers provided and most of these case packers have worked on the principle of providing a stream of the articles to be packaged moving along a controlled route, grouping the articles into a case packing relation and withdrawing the support for the grouped articles whereby they drop down into an associated case. Normally the case is provided by a supply conveyor and it is elevated to a position immediately below the grid for receipt of the articles collected thereon and dropped therethrough into the case.

Such prior type of case packer requires that the case be supplied to a given lift mechanism, the lift mechanism be actuated to engage the case with drop fingers depending from the grid, the articles be dropped from the grid into the case, the lifter mechanism be lowered, and the case be started on its way for further processing while the grid is being recharged with a new group of articles for case packing action.

It has been believed that faster and more accurate case packing actions can be obtained if the cases are moved along on a horizontal path and the articles to be packaged would be dropped down into these cases while positioned below the grid article assemblying apparatus. Such type of an apparatus might involve vertical movement of the article carrying grid into the case because dependent spring drop fingers must be associated with the articles as they are deposited into a case and such drop fingers must extend down into the case pockets for guiding the articles properly for deposit action. Hence, it has been necessary to either move the grid with relation to the case so that its dependent fingers would engage the case, or in a more logical approach to the problem, an intermediate auxiliary or lower grid has been provided between the main grid and the case for vertical movement down into the case for final article guide action and then to bring such lower grid upwardly out of engagement with the case to release the same for further processing. By such type of an apparatus, the cases are not required to be lifted while case filling action is secured and a more rapid or dependable case filling action may be obtainable.

In prior work done in the case packer field, U.S. Pat. No. 2,686,623 on a different style case packer was noted. This case packer has an upper grid means with dependent drop fingers and an auxiliary grid is present with drop fingers depending therefrom. The auxiliary grid can be brought up immediately adjacent the upper grid to nest the fingers together and then it can be lowered vertically to insert the fingers from the lower grid into an associated case for article deposit action in a completely guided and controlled manner. Somewhat similar apparatus is also provided in U.S. Pat. No. 2,735,599 wherein a grid has dependent drop fingers and the grid can be moved vertically on slide rods in the apparatus. Hence, an article deposit action is obtained by grid vertical movement rather than by any case lifting action.

The general object of the present invention is to provide an improved case packer apparatus which is quite rapid in operation and which will set up and control a guided drop of the articles into cases to fill the same.

Another object of the invention is to use an upper grid and a lower grid in a case packer apparatus and to move the lower grid vertically in the apparatus position down into a case engaging position at substantially the same time that articles are released by the upper grid for gravity deposit down into the case.

Other objects of the invention are to provide dependent drop fingers on an upper grid and a lower grid, which drop fingers will nest vertically into each other by a relative telescopic motion therebetween; to provide an improved case stop apparatus in case packer means for retarding forward movement of a case when at the case filling station; to provide a relatively uncomplicated case packer apparatus having improved properties; to make the apparatus readily variable for handling cases of different sizes or numbers of articles or different grouping relationships of the articles; and to provide an apparatus which is mechanically dependable and can function operatively for an extended service life with a minimum of maintenance.

Reference now is made to the accompanying drawings, wherein:

FIG. 2 is a vertical section taken on line a—a of FIG. 1;

FIG. 4 is a partially diagrammatic side view, partially in vertical section, of the lower grid in its upper position adjacent the upper grid with the drop fingers in nesting relationship;

FIG. 5 is a side elevation, fragmentary, and partially diagrammatic and in vertical section, of the case stop means and associated mechanism with the stop bar in inoperative position;

When referring to corresponding members shown in the drawings and referred to in the specification, corresponding numerals are used to facilitate comparison therebetween.

SUBJECT MATTER OF THE INVENTION

Figures 1, 3, 6, 7:
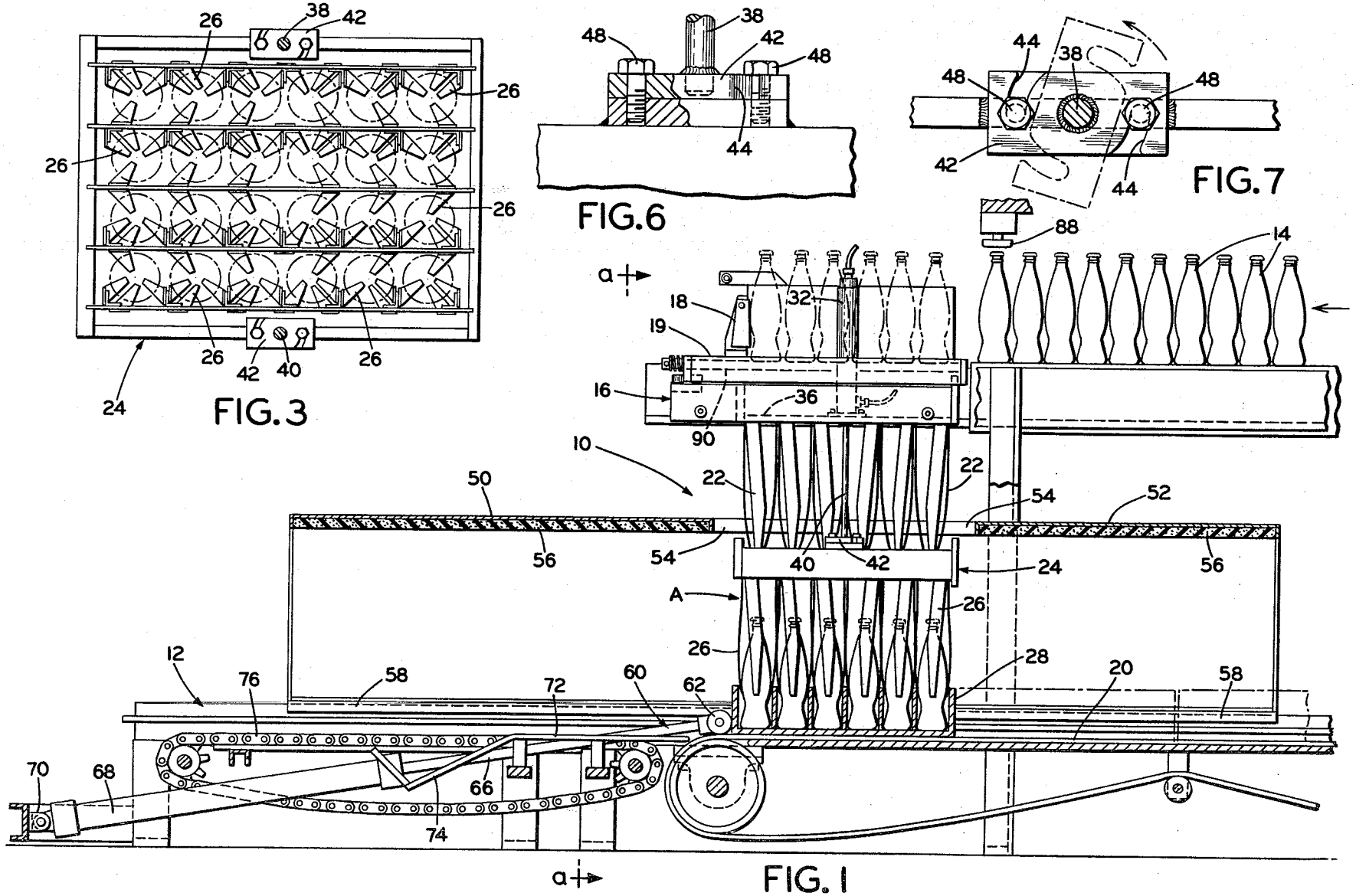
FIG. 1 is a side elevation, partially shown in vertical section of the article caser apparatus embodying the principles of the invention.
FIG. 3 is a plan view of the lower grid.
FIG. 6 is a fragmentary enlarged partly sectional side elevation of a quick disconnect coupling between the upper grid and lower grid.
FIG. 7 is a fragmentary plan of the quick disconnect coupling between upper and lower grids showing the coupling in its released form in dotted lines.
Figure 8:
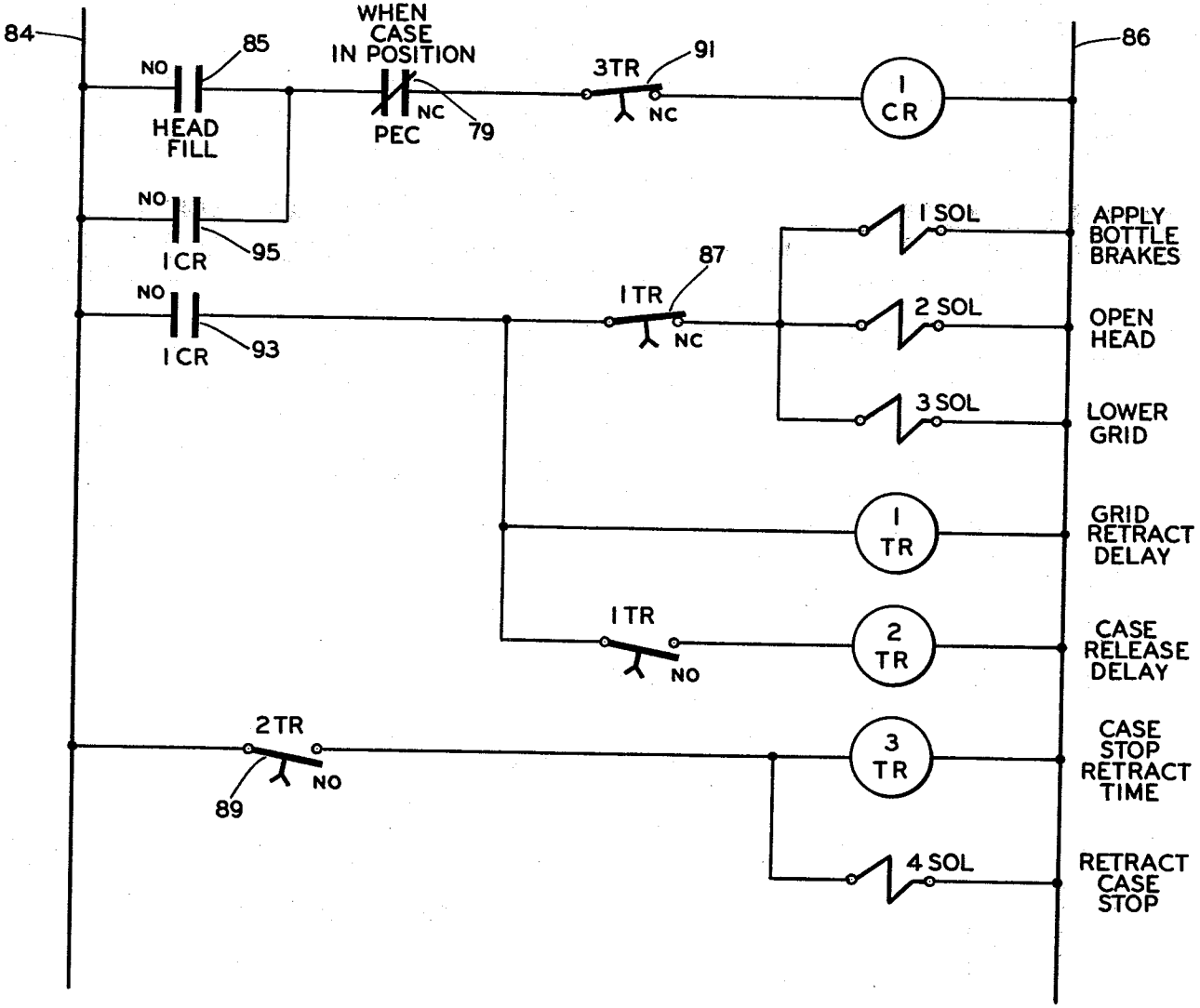
FIG. 8 is a diagrammatic wiring diagram of a typical control circuit for the case packer of the invention.

The present invention relates to a case packer apparatus, including an upper grid for collecting a group of articles in case filling relation, which grid is associated with an article supply mechanism of a conventional nature, and dependent drop fingers on the grid for the collected articles; which apparatus is characterized by a lower grid of corresponding size and article grouping as the upper grid, and having dependent drop fingers thereon, a driven case supply conveyor having a horizontal course positioned below said upper grid, and position control means securing the lower grid to the upper grid for vertical movement of the lower grid from a position adjacent the upper grid to a lowered position with its drop fingers engageable with a case on the conveyor, the upper and lower grids and the portion of the case supply conveyor vertically thereunder defining an article drop area in the apparatus. The position control means for the lower grid include a pair of cylinders positioned on vertical axis and secured to laterally opposed portions of the upper grid and means securing the lower grid to the piston rods of the cylinders; and a controlled case stop member is also provided for removable association with the article drop area to temporarily retain cases thereat for article deposit therein.

Attention now is particularly directed to the accompanying drawings, where a case packer apparatus is indicated as a whole by the numeral 10. This case packer apparatus includes a suitable frame 12 that supports a conventional article supply (not shown) thereon. Such conveyor supplies a plurality of rows of abutted articles 14 for supply to a grid 16 provided at the downstream end of the frame 12. This grid 16 is of relatively conventional construction and is adapted to arrange a plurality of articles thereon in case filling groups, as is conventional. This grid conventionally has a known control means thereon for indicating when the grid is filled with a desired group of articles, and such means comprises the members indicated broadly at 18 and being connected in a control circuit and apparatus of the construction disclosed in more detail in U.S. Pat. No. 3,421,285. Hence, when the grid is filled with articles, a suitable signal can be provided to the apparatus for control functions, including termination of flow of further articles to the grid 16 and, also, to provide for movement of a grid release assembly, as shown in U.S. Pat. No. 3,052,071 for release of articles collected in the grid when desired. Further flow of additional articles to the grid may be controlled as by the teachings of U.S. Pat. No. 3,052,071.

The case packer apparatus 10 also mounts any suitable type of case supply conveyor 20 thereon, and conventional means connect thereto for drive of this case supply conveyor 20 along a horizontal upper course, a portion of which moves directly below the main grid 16 and defines an article drop area A, indicated in FIG. 1 of the drawings.

Any suitable case supply means or other conveyors can be provided upstream of the case supplier 20, as desired, in order to supply cases to this conveyor 20 in desired timed, spaced intervals, all as is more or less conventional in the art.

The grid 16 has a plurality of resilient drop fingers 22 suitably secured thereto and dependent therefrom, as shown, for example, in U.S. Pat. No. 3,385,027 to provide a group of four drop fingers for each article on the grip 16.

An important feature of the present invention is the provision of a lower grid, indicated as a whole by the numeral 24, which has the same spacing and relationship or assembly of drop fingers therein for deposit of articles therethrough to correspond to the drop areas provided in the main grid 16. Such lower grid 24 is positioned vertically underneath and aligned with the upper grid 16 and suitable groups of drop fingers 26 are secured to and extend downwardly from the lower grid 24. These lower drop fingers 26 are adapted to extend into a case 28 when positioned at the drop area A when the lower grid is in its lowermost position. The drop fingers 22 and 26 nest within each other when the lower grid is moved to its upper position, as shown in FIG. 4, wherein the lower drop fingers 26 are out of engagement with any cases at the area A or the articles in any such case at that area.

In order to position the lower grid 24 in desired controllable vertically aligned relationship with the upper grid 16, a pair of control cylinders 30,32 are suitably attached to and extend vertically upwardly from a pair of horizontal support bars or plates 34 and 36, respectively, FIG. 2 of the drawings, suitably secured to and forming a part of the main grid 16 as modified for use in the present apparatus. These cylinders are on vertical axes and piston rods 38 and 40, controlled by the cylinders, extend downwardly from the main grid through the support plates 34 and 36 to engage and support the lower grid. These piston rods can be connected to the lower grids in any desired manner and end plates 42 are shown attached to these piston rods to form part of a quick release coupling or attaching means provided for securing the lower grid 24 to the upper grid. Such end plates 42 are shown as provided with a pair of slots 44 extending into different lateral edges thereof, towards a center line of the support plates, and the slots are adapted to be received in, under, or engaged with a pair of cap screws 48 extending vertically upwardly from edge portions of the lower grid frame. Thus, a quick release engagement action is obtained by merely loosening or tightening the cap screws 48 slightly in relation to the end plates 42, whereby different groupings of articles or sizes of articles can be processed by changing the size of the lower grid frame. The upper grid frame 16 can be changed readily in a known manner.

FIG. 1 of the drawings also best shows that the drop area of the apparatus, and particularly adjacent the case supply conveyor 20, has an enclosure tunnel means associated therewith. Hence, tunnel sections 50 and 52 are shown with each section being slidably engaged with the lower portion of the frame 12 and extending in upstream and downstream directions from the area A. These tunnel sections 50 and 52 have cutouts 54 in the upper portions thereof, at the drop area, for passage of articles down to the conveyor 20, as well as to permit movement of the lower drop grid 24 down towards the conveyor. This tunnel preferably is made from a suitable metal shell that has a lining 56 provided therefor, which lining can be made from any suitable sound-absorbent material, such as a foamed polyurethane, suitably attached to the metal outer shell. And, if desired, the foam layer 56 may even have a metal reenforcing layer, not shown, embedded therein, if desired, whereby the sound of the article deposit and the functioning of the case packer 10 can be reduced appreciably. The tunnel sections 50 and 52 can be slid in opposite directions from the drop area A to expose the same for working thereon, or repair, as desired. The tunnel sections are in sliding engagement with support flanges 58 provided on a lower portion of this frame 12.

The flow of cases 28 through the apparatus is temporarily controlled or prevented by a case stop means or member 60 best shown in FIGS. 1, 4 and 5 of the drawings. This case stop member comprises a pair of devices or rollers 62 operatively mounted on a cross bar 64 that is secured to the end of a piston rod 66. This piston rod 66 is controlled by a cylinder 68 the downstream end of which is pivotally supported at 70 on a portion of the frame 12 or equivalent fixed member whereby the cylinder is free to pivot slightly in a vertical plane. The rollers 62, when extended by the piston rod 66, roll up onto the downstream end of the case supply conveyor 20, as indicated in FIG. 1, while when the piston rod is retracted, FIG. 5, then the rollers have moved longitudinally of the apparatus and also vertically downwardly of the apparatus to release the case 28 for further movement downstream. The case has been filled with articles in the drop area A. The rollers 62 have their vertical positions determined by a pair of support angles or bars 72 that have a dependent downstream end 74 so that as the piston rod is retracted, the rollers ultimately move downwardly in the apparatus to a position below a suitable two loop, case transfer conveyor 76 provided at the downstream end of the apparatus. This conveyor 76 is suitably driven and it comprises a pair of endless chain loops that extend in a horizontal plane on an operative upper course thereof downstream of the apparatus from the article drop area A. The conveyor 76 receives filled cases from the conveyor 20 when discharged therefrom. Then the cases can be discharged onto any desired receiver therefor for further processing and shipment, as desired.

Other portions of the apparatus are well known and conventional with the grid and dependent grid fingers normally being of substantially the same construction as shown in our prior U.S. Pat. No. 3,385,027; and the case packer article feed control means are of the type shown in U.S. Pat. No. 3,421,285 for the means 18 for actuating the bottle control stoppers 88. U.S. Pat. No. 4,160,354 is on yet another type of an article packing head fill safety device that may be used in the practice of the present invention and which activates a control switch member for in turn moving a slide grid frame 19 laterally of the main grid frame for article release and drop therethrough all as is conventional in the trade. The article slide grid of the present invention is like that shown in such U.S. Pat. No. 4,160,354 and the control means for moving the slide grid frame laterally can be of any conventional construction.

It should be noted that the upper grid frame 16 may not have the dependent guide fingers 22 thereon and any suitable guide members as required may be associated with the lower grid frame 24 and extend a short distance upwardly therefrom to receive the bottles as dropped through the upper grid frame. Or any suitable guides may depend from the upper grid to lead dropped articles into and through the lower grid frame for guided deposit down into the associated case by the dependent spring guide fingers 26 of the present apparatus.

CONTROL SYSTEM

The presence of an empty case at the bottle drop area is sensed by suitable means such as a light 80 and photoelectric cell 82 secured to opposed parts of the apparatus frame at the drop area A. The case 28 reaching the area A is stopped by the stop means 60, specifically the rollers 62 that are in the operative position shown in FIG. 1 when the upper grid 16 is being filled by streams of the articles being processed. Power is supplied for the control circuit by leads 84 and 86 and when an empty case is at position A, PEC contact 79 is closed by the circuit of the photocell 82. When the upper grid is filled with bottles "head fill" contact 85 is closed by a circuit actuated by the grid control means 18. This energizes the coil of relay 1CR which then holds in through its own contacts 95.

Relay 1CR, when energized, energizes circuits for solenoid valves 1SOL, 2SOL, 3SOL, by closing contact 93. These solenoid valves apply bottle brakes 88 of a known type in the apparatus, move the primary head skid blades 90 to release position, and start lowering the secondary grid, respectively, by the cylinders 30 and 32. The positions of a support frame made from the skid blades 90 are controlled conventionally as generally shown and described in U.S. Pat. Nos. 4,160,354 and 3,052,071. The operating coil of timer 1TR is also energized by contacts 93 of relay 1CR and starts timing and its controlled contacts 87 remain closed. When the grouped bottles 14 have had ample time to fall through the lower grid 24 into the case, timer 1TR contact times out and opens contact 87, de-energizing solenoid valves 1SOL, 2SOL and 3SOL. These valves then release the bottle brakes 88, close the slide grid or skid blades to its operative position, and pull the lower grid 24 to its upper position by cylinders 30 and 32. The primary grid head 16 can now begin to fill in preparation for the next cycle.

Timer 2TR is energized at this time when timer 1TR is energized and it begins its timing cycle. After a short delay, long enough for the lower grid to clear the case, timer 1TR contact 89 is closed, energizing solenoid valve 4SOL. This solenoid valve causes the case stop means 60 to retract by movement of stop members 68, allowing the full case to discharge from the machine. Timer 3TR starts timing when timer 2TR is energized and contact 89 closed. After a short delay, 3TR times out and its contact 91 temporarily opens, dropping out control relay 1CR and all other control circuits to prepare the system for the next packing cycle. Contacts 91 close after 1CR is released and contacts 85 are also open at that time.

It should be noted that the lower grid 24 is started to move downwardly and then immediately thereafter the grid slide frame is actuated to release the bottles 14. But, if desired, the bottles 14 can be released concurrently with movement start of the grid 24 depending on how fast the bottles drop down to reach a case in relation to how long it takes the mechanism to lower the fingers 26 into the case 28 as the fingers 26 must be operatively positioned before the bottles drop therethrough.

As previously indicated, parts of the apparatus are shown diagrammatically and pressure supply lines and/or control valves used in the apparatus are omitted.

The apparatus will function efficiently and effectively for article casing actions. And the filled cases 28 can be gradually released by the stop means 60 to accelerate slowly up to the speed of the conveyor 76.

The apparatus 10 achieves the objects of the invention.

While one complete embodiment of the invention has been disclosed herein, it will be appreciated that modification of this particular embodiment of the invention may be resorted to without departing from the scope of the invention.

What is claimed is:

1. A method of packing articles in case where streams of articles are supplied to a packer drop area, and are collected in a group of articles positioned in case filling relation on an upper grid at the drop area including the steps of:

positioning a lower grid of corresponding size and article grouping as the upper grid below and in vertical alignment therewith, dependent drop fingers being present on said lower grid, moving a supply of cases along a horizontal course positioned below said lower grid, stopping an empty case when it is moved into alignment with said grids, sensing when a case is at said drop area and sensing when said grid is full of articles, moving said lower grid downwardly when both of said sensing means are actuated, and releasing articles on said upper grid simultaneously with start of movement of said lower grid downwardly.

2. A case packer apparatus including means for supply of streams of articles to a packer area, and an upper grid for collecting a group of said articles in case filling relation, and characterized by a lower grid of corresponding size and article grouping as the upper grid, dependent drop fingers being present on said grids, said grids being in vertical alignment, a driven case supply conveyor having a horizontal course positioned below said upper grid, position control means securing said lower grid to said upper grid for vertical movement of said lower grid from a position adjacent said upper grid where said drop fingers nest together to a lowered position with its drop fingers engageable with a case on said conveyor; and said upper grid including releasable article support means, and said grids are at an article drop area of the apparatus, an electrical sensing means for sensing cases at said drop area, an electric sensing means to sense when said grid is full of articles, electric means to actuate said control means to start to move said lower grid downwardly immediately after both of said sensing means are actuated, said lower grid having a normal position elevated out of contact with any cases on said conveyor, and a control member to release articles on said grid by said releasable support means only when said lower grid has been started to be moved downwardly.

3. A case packer apparatus including an upper grid for collecting a group of articles in case filling relation, a grid slide frame on said upper grid and having article support and release positions and characterized by a lower grid of corresponding size and article grouping as the upper grid, dependent drop fingers on said lower grid, a driven case supply conveyor, having a horizontal course, positioned below said upper grid, position control means securing said lower grid to said upper grid for vertical movement of said lower grid from a position adjacent said upper grid and out of contact with any case to a lowered position with its drop fingers engageable with a case on said conveyor, a stop member for said cases including a case engaging device operatively associated with said case supply conveyor, a control cylinder for said stop member connecting to said device by a piston rod, said control cylinder operating to move said device so as to engage and retard a case on said case supply conveyor when said piston rod is extended, and a case discharge conveyor, said control cylinder extending longitudinally of said case supply conveyor, and said case engaging device has a retracted case release position associated with said case discharge conveyor.

4. A case packer apparatus as in claim 3, where said grids are at an article drop area of the apparatus, a first sensing means for sensing a case at said drop area, a second sensing means to sense when said grid is full of articles, means to actuate said control means to move said lower grid downwardly when both of said sensing means are actuated, said lower grid having a normal position elevated out of contact with any cases on said conveyor, and control means to move said grid slide frame to release articles supported thereon substantially simultaneously with said lower grid being moved downwardly.

5. A case packer apparatus including an upper grid for collecting a group of articles in case filling relation, a grid slide frame on said upper grid and having article support and release positions and characterized by a lower grid of corresponding size and article grouping as the upper grid, dependent drop fingers on said lower grid, a driven case supply conveyor, having a horizontal course, positioned below said upper grid, position control means securing said lower grid to said upper grid for vertical movement of said lower grid from a position adjacent said upper grid and out of contact with any case to a lowered position with its drop fingers engageable with a case on said conveyor, a stop member for said cases including a case engaging device operatively associated with said case supply conveyor, a control cylinder for said stop member connecting to said device by a piston rod, said control cylinder operating to move said device so as to engage and retard a case on said case supply conveyor when said piston rod is extended, said control cylinder extending longitudinally of said conveyor, a case discharge conveyor being present, means pivotally support said control cylinder at its downstream end at a distance from the downstream end of said conveyor, and guide means for said case engaging device to guide it to a lowered inoperative position with retraction of said piston rod whereby a released case can move onto said case discharge conveyor.

* * * * *